US006206568B1

(12) United States Patent
Wurr

(10) Patent No.: US 6,206,568 B1
(45) Date of Patent: Mar. 27, 2001

(54) FLEXIBLE SHIPPING CONTAINER

(75) Inventor: Egon Wurr, Rheine (DE)

(73) Assignee: Eurea Verpackungs GmbH & Co. KG, Rheine (DE)

( * ) Notice: Subject to any disclaimer, the term of this patent is extended or adjusted under 35 U.S.C. 154(b) by 0 days.

(21) Appl. No.: 09/351,016

(22) Filed: Jul. 12, 1999

(30) Foreign Application Priority Data

Oct. 13, 1998 (DE) ..... 298 18 049 U

(51) Int. Cl.[7] ..... B65D 33/25

(52) U.S. Cl. ..... 383/97; 383/24; 383/71; 383/111

(58) Field of Search ..... 383/41, 80, 81, 383/97, 111, 67, 71, 24

(56) References Cited

U.S. PATENT DOCUMENTS

| | | | | |
|---|---|---|---|---|
| 2,696,235 | * | 12/1954 | Toffolon | 383/41 X |
| 2,913,029 | * | 11/1959 | Paton | 383/97 X |
| 3,949,901 | * | 4/1976 | Tokita | 383/41 X |
| 4,083,392 | * | 4/1978 | Kobayashi | 383/97 X |
| 4,390,051 | * | 6/1983 | Cuthbertson | 383/111 |
| 4,415,012 | * | 11/1983 | Bose | 383/67 X |
| 4,917,507 | * | 4/1990 | Davidson | 383/67 |
| 5,011,008 | * | 4/1991 | Baker | 383/97 X |
| 5,192,134 | * | 3/1993 | Polett | 383/111 X |
| 5,368,395 | * | 11/1994 | Crimmins | 383/111 X |

FOREIGN PATENT DOCUMENTS

| | | | | |
|---|---|---|---|---|
| 25 12 014 | * | 9/1976 | (DE) | 383/41 |
| 2800736 | | 7/1978 | (DE) . | |
| 4127201 | | 2/1993 | (DE) . | |
| 9213812 | | 2/1993 | (DE) . | |
| 4336256 | | 4/1995 | (DE) . | |
| 296 12 225 U | | 10/1996 | (DE) . | |
| 0338181 | | 10/1989 | (EP) . | |
| 2 372 748 | * | 6/1978 | (FR) | 383/67 |

* cited by examiner

*Primary Examiner*—Jes F. Pascua
(74) *Attorney, Agent, or Firm*—Milde, Hoffberg, Macklin, LLP

(57) ABSTRACT

A flexible shipping container (100), particularly for bulk material, is disclosed. The container consists of a cylindrical or cube-shaped carrying bag (2) made of a fabric of synthetic fiber or synthetic thread. On one upper side panel edge (4), the carrying sack is provided with a lid section (5), where the lid section (5) is connected to the carrying sack (2) with a zipper (7) at least around a portion of its circumference. In this manner, it is possible to open or remove entirely the lid section simply by pulling open the zipper. The interior of the carrying sack is then freely accessible for cleaning or repair work, or to insert an inner sack made of synthetic foil. After the work is finished, the lid section is reconnected to the carrying sack using the zipper and the container is ready for renewed use.

3 Claims, 2 Drawing Sheets

FLEXIBLE SHIPPING CONTAINER

BACKGROUND OF THE INVENTION

The invention relates to a flexible shipping container, particularly for bulk goods, with a cylindrical or cube-shaped carrying bag made of fabric of synthetic fiber or synthetic thread. The shipping container has a lid section in the region of the upper side panel edge of the carrying bag.

A shipping container of this type is known from the German Patent No. 28 00 736. For this container, cuts from a fabric, particularly a cross-laminated synthetic fabric, are connected by sewing or gluing to form a cylindrical or cube-shaped carrying bag. It is advantageous for such a shipping container to have a large volume and load capacity with a small weight of its own. The empty container can be folded up and takes up very little storage space.

It is further known to provide a lid section on the top and/or bottom side to prevent the overflow of bulk material, such as synthetic granules, over the upper side panel edge. Filling of such containers with a lid section, as presented in the German Patent No. 92 13 812 U1, is usually done through a fill opening, that may continue as a short fill tube. After filling the container, the opening, or the tube, is tied up with a cord, for example, such that spilling of the bulk material from the fill tube is prevented. For bulk material with a very small particulate size, or for food supplies and/or pharmaceutical substances, it is known to provide an inner sack made of synthetic foil material that ends at the fill opening or the fill tube. This prevents a trickling out of the bulk material through the synthetic fabric of the carrying bag, or soiling of the bulk material from the outside, respectively.

The disadvantage of this arrangement is that, in order to obtain a clean shipping container, a new inner sack needs to be inserted with substantial effort when re-using the shipping container for goods of the type mentioned above. For this purpose, the present inner sack needs to be removed through the small fill opening and a new inner sack inserted through the same path. Replacing the inner sack is time-consuming and requires additional devices, for example, to blow up the inner sack to ensure complete unfolding of the inner sack on the inside of the shipping container.

Experiments to attach the lid section to the side panels of the shipping container using Velcro have brought less than satisfactory results because the load capacity of a Velcro connection is weak in itself and is additionally reduced as the hook and loop bands get dirty. This results in the undesired loosening of the lid section.

SUMMARY OF THE INVENTION

It is, therefore, a principal object of the present invention to further develop a shipping container of the kind mentioned above such that the connection between the lid section and the carrying bag can be disconnected and reconnected quickly and such that the lid connection is also capable of withstanding the high tensile forces at the lid section that arise during use.

This object, as well as other objects which will become apparent from the discussion that follows, are achieved in accordance with the present invention, by connecting the lid section to the carrying bag in at least a portion of its circumference by means of a zipper.

Zippers are available on the market in practically any desired length. Also known are reinforced designs from recreational and sports articles. To construct a shipping container according to the invention barely increases the manufacturing costs and the additional costs pay for themselves at the first re-working for the re-use of the shipping container.

With a lid section of a shipping container made according to the invention, it is possible to open or totally remove the lid section simply by pulling open the zipper. The interior of the carrying bag is then freely accessible for performing cleaning or repair jobs or to insert a new inner sack made of synthetic foil.

At the end of the work, the lid section is again connected with the carrying bag using the zipper and is again ready for use.

It is further advantageous that the entire lid section can be replaced when the zipper extends around the entire circumference. Thus, either an entirely closed lid section or one with a fill opening or fill funnel can be installed depending on the purpose of the application. For this purpose, the carrying bag only needs to be stocked with one half of the zipper sewed to the bag and it can then be combined with various lid section designs.

Additionally, it is recommended to close the fill opening with a sealing cover. It can be sealed under the fill opening from the inside instead of using a fill opening flap. This would, on the one hand, prevent shipped goods from spilling through the remaining opening, or prevent the goods from getting dirty, respectively, and on the other hand, through the unbroken seal—together with a sealed zipper—it would indicate tithe recipient immediately that the freight is intact. When re-using the shipping container, the lid section, together with the broken sealing cover will be replaced entirely.

The lid section can be connected to the upper side edge of the carrying bag. It is also possible to design the bottom of the carrying bag with a zipper connection according to the teaching of the invention.

Finally, it is advantageous to prepare a lid section as a spare part for a shipping container according to the invention, where an inner sack, particularly one made of a synthetic foil material and ending at the fill opening is provided for the lid section. The manufacturer of the shipping container can supply the user with such a ready-to-use lid section with inner sack, and the user can then himself replace a used or dirty inner sack with a new one by using the zipper for removing and attaching the lid. Avoiding a return shipment to the manufacturer increases the economic efficiency of reusing the shipping container.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
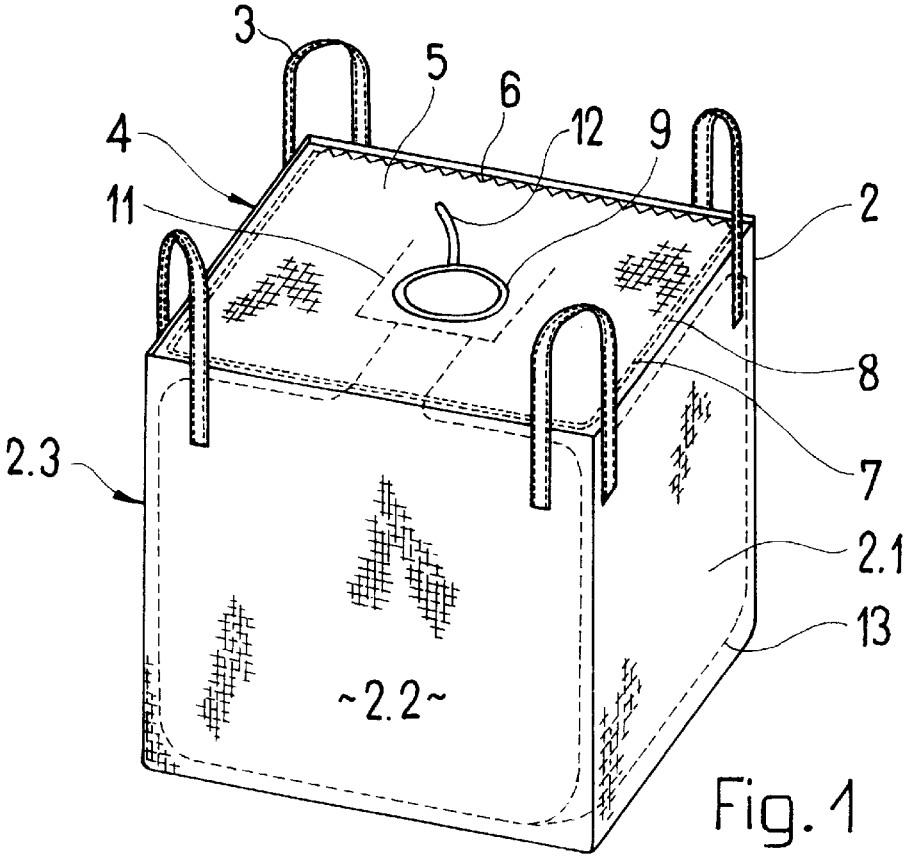
FIG. 1 is a perspective view of a flexible shipping container according to a preferred embodiment of the present invention.

The preferred embodiments of the present invention will now be described with reference to FIGS. 1, 2 and 3 of the drawings.

Identical elements in the various figures are designated with the same reference numerals.

Shown in FIG. 1 is a shipping container 100 in perspective view. Basically, the shipping container 100 consists of a carrying bag 2 with carrying loops 3 attached at the corners as well as a lid section 5. In the exemplary embodiment shown here, the cube-shaped carrying bag 2 is made of four side parts 2.1, 2.2 and 2.3 as well as a bottom section not shown here. In the area of the upper edge 4 of the side wall, the lid section 5 is connected to the carrying bag 2 along one edge via a seam 6. Using a zipper 7, a removable connection is made to the remaining side panels 2.1, 2.2, 2.3.

Advantageously, the flexible container may be provided with an inner sack 13 made of synthetic foil material.

Figure 2:
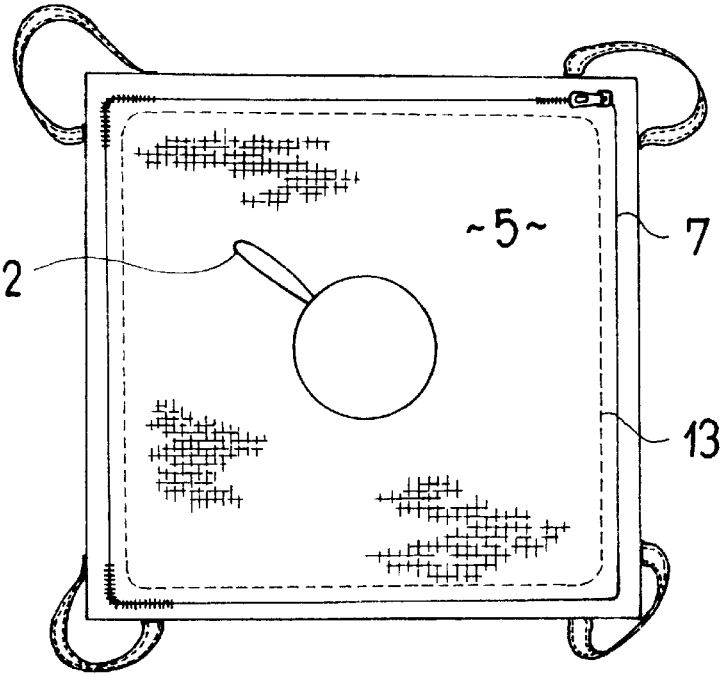
FIG. 2 is a top view a flexible shipping container showing an alternative embodiment of the present invention.

FIG. 2 shows an alternative embodiment whereby the zipper 7 extends all the way around the circumference of the lid. The lid is otherwise identical to that shown in FIG. 1.

In its center, the lid section 5 is equipped with a fill opening 9 that can be closed with a pull cord 12. A fill opening flap 11 is placed under the fill opening to prevent spilling of the bulk material from the remaining opening after closing it with the pull cord 12. In place of the fill opening flap 11, a sealing cover may be glued or welded to the lid under the fill opening 9.

The upper opening of the inner sack 13 terminates at the fill opening 9.

Figure 3:
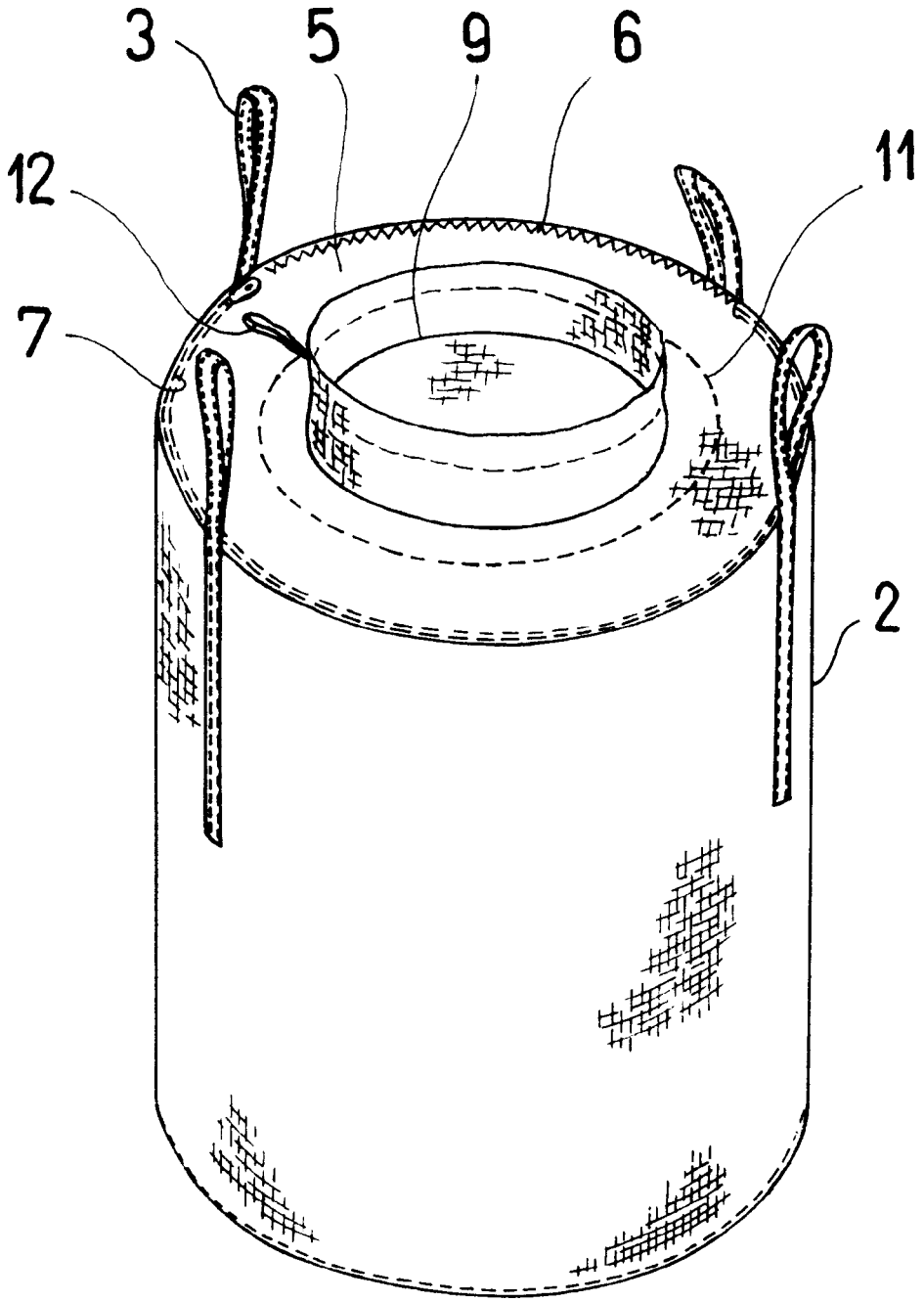
FIG. 3 is a perspective view of a cylindrical flexible shipping container according to a preferred embodiment of the present invention.

In FIG. 3, in this cylindrical embodiment of the shipping container 100, the zipper 7 goes around the whole lid, which is the main feature. This shipping container 100 also consists of a carrying bag 2 with carrying loops 3 attached thereto. There is also a lid section 5 which is connected to the carrying bag 2 along one edge via a seam 6. The lid section 5 is equipped with a full opening 9 than can be closed with a pull cord 12. A fill opening flap 11 is placed under the fill opening to prevent spilling of the bulk material from the remaining opening after closing-it with the pull cord 12. In place of the fill opening flap 11, a sealing cover may be glued or welded to the lid under the fill opening 9. The zipper 7, as stated above, goes around the whole lid.

The shipping container according to the present invention, as shown in FIG. 11 will now be described by way of an example:

A cross-laminated polypropylene fabric with an area weight of 200 g/m$^2$ with a full-surface PP coating with 30 g/m$^2$ is used to manufacture a shipping container. The side panels of the carrying bag have a width of 1200 mm and 1100 mm respectively and a length of 1000 mm. Together with an appropriate bottom section, this results in a shipping container with a rectangular cross-section that is open on the top.

The lid section is made of the same material. It is equipped with a centrally located fill opening with a diameter of 300 mm that is shaped as a collar and can be tightened with a pull cord such that an opening of less than 50 mm remains. This remaining opening is sealed with a sealing cover welded to the coated bottom side of the lid section. The sealing cover is made of a 50 $\mu$m thick section, of PE foil, 400×400 mm in size.

A PP cord 7 mm in diameter is used as the pull cord 12 and is sewed into a 30 mm wide hem at the fill opening. The lid section is sewn completely to one of the side edges of the carrying bag. A zipper is attached to the remaining side panels of the carrying bag and the remaining edges of the lid section. Using distance strips with a width of 125 mm sewn on the edge, the zipper is offset from the upper side panel edge towards the center, resulting in an entire zipper length of 2900 mm.

There has thus been shown and described a novel flexible shipping container which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a flexible shipping container, particularly for bulk material, with a cylindrical or rectangular parallelepiped-shaped carrying bag made of fabric of synthetic fiber or synthetic thread, said shipping container having a lid section connected to an upper side panel edge of the carrying bag, the improvement wherein the lid section is connected to the carrying bag with a zipper around at least a portion of the lid's circumference; wherein the lid section includes a fill opening that can be partially closed with a pull cord; said shipping container further comprising an inner sack ending at the fill opening and a sealing flap, disposed beneath the fill opening, to prevent bulk material from spilling through the fill opening during handling of the shipping container.

2. A shipping container according to claim 1, wherein the inner sack is made of a synthetic foil material.

3. A shipping container according to claim 1, wherein the lid section is attached with a zipper around its entire circumference such that it can be completely removed from the carrying bag.

* * * * *